US006982139B2

(12) United States Patent
Horikoshi et al.

(10) Patent No.: US 6,982,139 B2
(45) Date of Patent: Jan. 3, 2006

(54) ELECTROPHOTOGRAPHIC COLOR TONER, AND ELECTROPHOTOGRAPHIC COLOR DEVELOPER, TONER CARTRIDGE, IMAGE FORMING DEVICE AND IMAGE FORMING METHOD USING THE SAME

(75) Inventors: Yuzo Horikoshi, Tokyo (JP); Katsuji Ebisu, Tokyo (JP); Takahiro Kashikawa, Tokyo (JP)

(73) Assignee: Fuji Xerox Co., LTD, Tokyo (JP)

( * ) Notice: Subject to any disclaimer, the term of this patent is extended or adjusted under 35 U.S.C. 154(b) by 141 days.

(21) Appl. No.: 10/445,836

(22) Filed: May 28, 2003

(65) Prior Publication Data

US 2003/0224274 A1 Dec. 4, 2003

(30) Foreign Application Priority Data

May 28, 2002 (JP) ..... 2002-153568

(51) Int. Cl.
*G03G 9/00* (2006.01)

(52) U.S. Cl. ..... 430/108.6; 399/252

(58) Field of Classification Search ..... 430/108.6; 399/252

See application file for complete search history.

(56) References Cited

U.S. PATENT DOCUMENTS

| | | | | |
|---|---|---|---|---|
| 2,297,691 | A | 10/1942 | Carlson | |
| 5,135,832 | A * | 8/1992 | Sacripante et al. | 430/108.6 |
| 6,383,704 | B1 * | 5/2002 | Kataoka et al. | 430/108.6 |

FOREIGN PATENT DOCUMENTS

| | | |
|---|---|---|
| JP | 56-128956 | 10/1981 |
| JP | 57-79961 | 5/1982 |
| JP | 58-1157 | 1/1983 |
| JP | 59-52255 | 3/1984 |
| JP | 60-112052 | 6/1985 |
| JP | 60-238847 | 11/1985 |
| JP | 4-40467 | 2/1992 |
| JP | 4-348354 | 12/1992 |
| JP | 7-175258 | 7/1995 |
| JP | 7-223815 | 8/1995 |
| JP | 7-225489 | 8/1995 |
| JP | 2001-194823 | 7/2001 |

* cited by examiner

*Primary Examiner*—Mark A. Chapman
(74) *Attorney, Agent, or Firm*—Westerman, Hattori, Daniels & Adrian, LLP

(57) ABSTRACT

An electrophotographic color toner at least includes a colorant, a binder resin and an additive, wherein the additive includes at least any of burned fine particles selected from titanium oxide fine particles and tin oxide fine particles obtained by a burning process.

17 Claims, 1 Drawing Sheet

ELECTROPHOTOGRAPHIC COLOR TONER, AND ELECTROPHOTOGRAPHIC COLOR DEVELOPER, TONER CARTRIDGE, IMAGE FORMING DEVICE AND IMAGE FORMING METHOD USING THE SAME

BACKGROUND OF THE INVENTION

1. Field of the Invention

The present invention relates to an electrophotographic color toner having low resistance, capable of forming images excellent in image quality and chroma and causing no failure of the image forming device and the like to be used, and relates to electrophotographic color developer, a toner cartridge, an image forming device and an image forming method using the same.

2. Description of the Related Art

Electrophotography is the technology widely used in the image forming devices such as a copying machine, an electrophotographic facsimile, and an electrophotographic printer. As the electrophotography, the system using a photoconductive insulator, for example, as described in U.S. Pat. No. 2,297,691, is generally used. In this system, the photoreceptor charged with corona discharge or a charge-supply roller is first irradiated with a light such as laser, LED and the like to form an electrostatic latent image thereon. Next, resin particles (toner) colored with pigments and dyes are electrostatically deposited on the electrostatic latent image to develop to obtain a visualized toner image. Subsequently, the toner image is transferred to a recording medium such as paper or film. The toner image is a powder image which is only placed on the recording medium at this stage, so that it needs to be fixed on the recording medium. In the last step, the toner image is fused with heat, pressure, light or the like and then solidified on the recording medium to finally obtain a toner image fixed on the recording medium.

In the fixing of the toner image, a powder toner containing a thermoplastic resin (called also as a "binder resin" below) as a main component is fused with heat to be fixed on the recording medium. Generally known fixing systems include a heat-roll system in which a recording medium on which a toner image is formed is directly heated and pressed with a roller and a flash fixing system in which the toner is fixed on the recording medium with the irradiation of flash light such as a xenon flash lamp.

Fine particles of resins in which a colorant or the like is dispersed in a binder resin have conventionally been used as the toner for use in the electrophotography. However, the properties of such toner itself such as storage stability, a flowability property, a developing property, transferability and chargeability are not sufficient. Therefore, when the toner is used, additives are often added to the toner for the purpose of improving these properties.

The additives proposed include fine particles of hydrophobic silica (Japanese Patent Laid-Open No. 56-128956), silica fine particles which are added with aluminum oxide or titanium oxide fine particles (Japanese Patent Laid-Open No. 60-238847), titanium oxide by a vapor-phase process which is subjected to hydrophobic treatment (Japanese Patent Laid-Open No. 58-1157 and No. 59-52255), anatase-type titanium oxide (Japanese Patent Laid-Open No. 60-112052), aluminum oxide-coated titanium oxide (Japanese Patent Laid-Open No. 57-79961), and titanium oxide synthesized by a wet-process (Japanese Patent Laid-Open No. 07-175258 and No. 07-225489). In addition, the technology for treating the surface of inorganic compounds to be used for external additives such as titanium oxide fine particles whose surface is treated with a coupling agent (Japanese Patent Laid-Open No. 04-40467 and No. 04-348354) is also proposed.

The development in the electrophotography uses the developer prepared by mixing colored resin particles that has chargeability and is called toner with magnetic carriers that frictionally charge the toner. A typical black toner generally contains carbon as a colorant. The carbon is conductive and reduces electrical resistance of the toner, so that the developing property is improved; the edge effect is prevented; and the excessive charging of the toner during continuous printing can be prevented.

However, as a color toner cannot incorporate carbon that is black, it has higher electrical resistance compared with a black toner, which results in a problem of easily causing failure in development.

Conventional color toners have conductive fine particles as an additive adhered to the toner surface to reduce the electrical resistance to improve the developing property. However, the conductive fine particles are adhered to the toner only electrostatically, so that there has been a problem that the conductive fine particles adhered to the toner are easily detached from the toner when the toner is mixed with the carrier. Once the conductive fine particles are detached, the electrical resistance of the toner increases to change the properties of the developer, causing a problem of preventing stable development.

In addition, there have been problems that the conductive fine particles detached during agitation cause image degradation by the leak of toner charge and also adhere to a charging device or a transfer device to cause the failure or the like of devices and components by the leak of high voltage.

Various technologies have been developed in which the conductive fine particles proposed as the external additives are internally added in the toner to reduce the resistance. However, for obtaining appropriate electrical resistance, the quantity to be added needs to be 20 weight % or more. If the conductive fine particles are added in 20 weight % or more, the toner could become opaque to reduce the chroma of the toner.

In addition, when the powder having a lower electrical resistance of 1 Ωcm or less compared with the conductive fine particles proposed as external additives is internally added in the toner, it has the effect to reduce the electrical resistance by an added quantity of only 20 weight % or less. However, the resistance is reduced excessively to cause the charge held by the toner to leak when the powder is exposed to the toner surface, resulting in a problem of preventing a stable electrostatic property.

Further, fine particles having a size from several nm to several μm are typically used for the conductive fine particles having low electric resistance. Although most of these fine particles exist as primary particles, they exist as the aggregate having a size of 10 μm or more. Such a large aggregate extremely reduces the electrical resistance of the toner, resulting in the problems of causing image degradation by the leak of toner charge and the failure or the like of a charging device or a transfer device by the leak of high voltage.

In particular, in the electrophotographic devices that conduct high speed printing having a printing speed above 800 mm/s, the agitation stress that is given to the toner is extremely large, dramatically increasing the quantity of the toner scattered with the conveying of developer. Consequently, such devices require much higher performance to work out the above described various problems than the relatively low-speed electrophotographic devices do.

SUMMARY OF THE INVENTION

The present invention has been made in view of the above circumstances and provides an electrophotographic color toner, an electrophotographic color developer, a toner cartridge, an image forming device and an image forming method using the same.

The electrophotographic color toner according to the present invention is the electrophotographic color toner in which at least a colorant, a binder resin and an additive are added (means both "internally added" and "externally added" in the present invention). The additive includes at least any of burned fine particles selected from titanium oxide fine particles and tin oxide fine particles obtained by a burning process. The burned fine particles have a small content of fine particles in an aggregated state, so that even when added in the toner, the leak of the toner charge caused by the presence of the aggregate will not occur. Therefore, the electrophotographic color toner according to the present invention has appropriately low resistance values, is capable of forming an image excellent in image quality and chroma and causes no failure of the image forming device to be used.

The electrophotographic color developer according to the present invention includes at least the above described electrophotographic color toner according to the present invention. Therefore, it has low resistance values, is capable of forming an image excellent in image quality and chroma and causes no failure of the image-forming device to be used.

The toner cartridge according to the present invention contains at least the electrophotographic color toner according to the present invention. Therefore, it allows forming an image excellent in image quality and chroma.

The image forming device according to the present invention at least has an electrostatic latent image carrier, electrostatic latent image forming means that forms an electrostatic latent image on the electrostatic latent image carrier, developing means that contains the electrophotographic color developer including the electrophotographic color toner according to the present invention and develops the electrostatic latent image to form a visible image, and transfer means that transfers the visible image to a transfer material. Thus, it allows forming an image particularly excellent in image quality and chroma and causes no problem of failure or the like in use.

The present invention can provide an electrographic color toner having low resistance, capable of forming an image excellent in image quality and chroma and causing no failure of the image forming device to be used, and electrophotographic color developer, a toner cartridge, an image forming device and an image forming method using the same.

BRIEF DESCRIPTION OF THE DRAWING

Preferred embodiments of the present invention will be described in detail based on the following FIGURE, wherein.

DETAILED DESCRIPTION OF THE PREFERRED EMBODIMENTS

Figure 1:
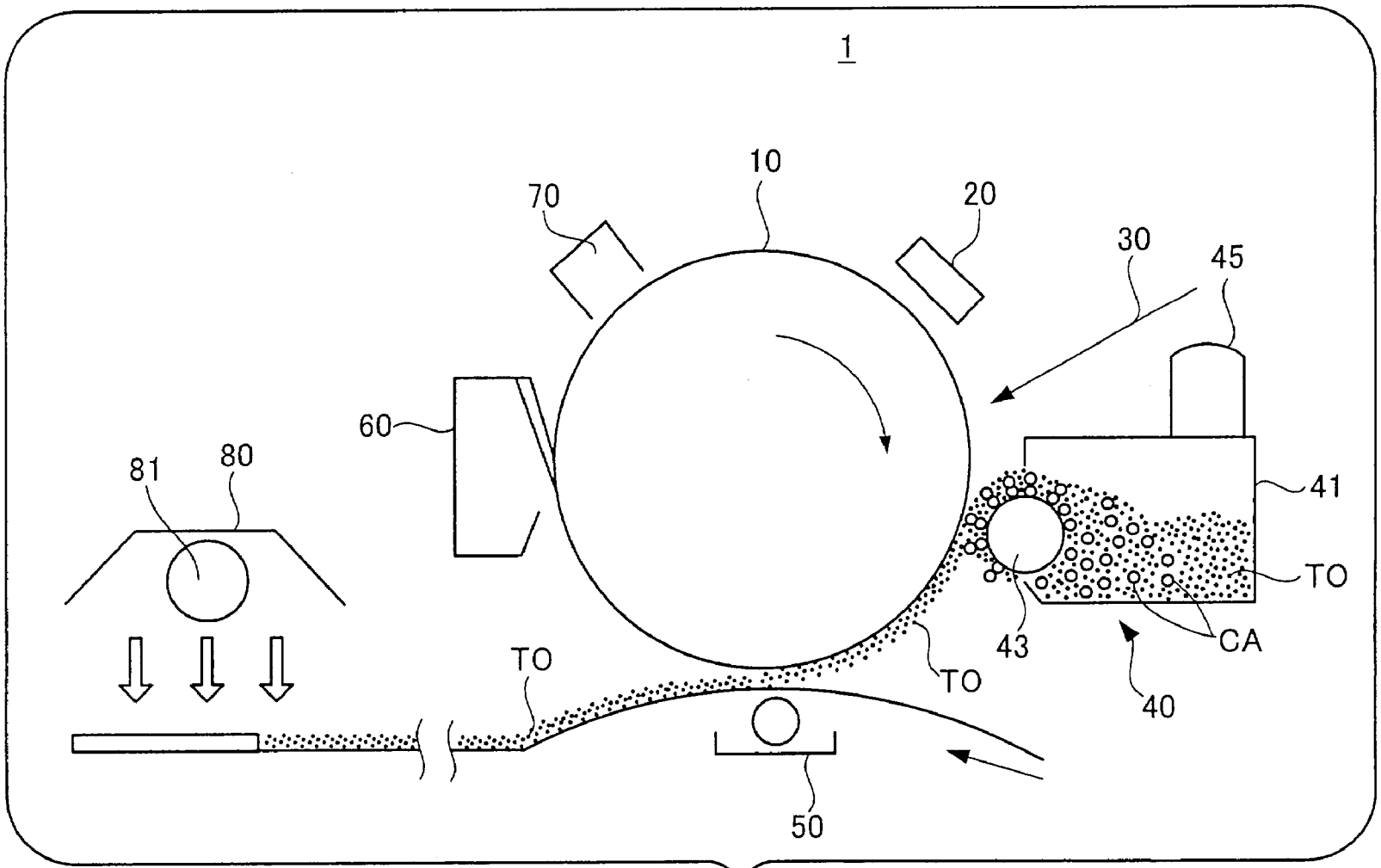
FIG. 1 schematically illustrates the image forming device according to the present invention.

The present invention will now be described in detail.

Electrophotographic Color Toner

The electrophotographic color toner according to the present invention includes at least a colorant, a binder resin and an additive, and also includes other components as necessary.

[Colorant]

The colorant is not particularly limited, and may be appropriately selected from well-known colorants depending on the purpose, and for example includes Yellow Colorants, Magenta Colorants, Cyan Colorants, Black Colorants and the like, specifically including Mono-azo Red Pigments, Dis-azo Yellow Pigments, Quinacridon Magenta Pigments, Anthraquinone Dyes, Nigrosine Dyes, Tris-azo Dyes and Pigments, Quaternary Ammonium Salts, Mono-azo Metal Complex Dyes and the like.

The colorants specifically include Carbon Black, Lamp black, Iron Black, Ultramarine, Nigrosine Dyes, Oil Black, Azo-oil Black, Rose Bengal, Naphthol, Carmine, Aniline Blue (C.I. No. 50405), Calco Oil Blue (C.I. No. Azoic Blue 3), Chrome Yellow (C.I. No. 14090), Ultramarine Blue (C.I. No. 77103), Dupont Oil Red (C.I. No. 26105), Quinoline Yellow (C.I. No. 47005), Methylene Blue Chloride (C.I. No. 52015), Phthalocyanine Blue (C.I. No. 74160), Malachite Green Oxalate (C.I. No. 42000), Food Color Red No. 2 (Amaranth, C.I. No. 16185), Food Color Red No. 3 (Erythrosine, C.I. No. 45430), Food Color Red No. 40 (Allura red AC, C.I. No. 16035), Food Color Red No. 102 (New Coccin, C.I. No. 16255), Food Color Red No. 104 (Phloxine, C.I. No. 45410), Food Color Red No. 105 (Rose Bengal, C.I. No. 45440), Food Color Red No. 106 (Acid Red, C.I. No. 45100), C.I. Pigment Reds 2, 3, 5, 6, 7, 23, 48:2, 48:3, 48:4, 57:1, 81:1, 122, 144, 146, 166, 169, 177, 184, 185, 202, 206, 220, 221, 254 and the like, Food Color Yellow No. 4 (Tartrazine, C.I. No. 19140), Food Color Yellow No. 5 (Sunset Yellow FCF, C.I. No. 15985), Quinoline Yellow, Hansa Yellow, Rhodamine 6C Lake, Chrome Yellow, Quinacridon, Benzidine Yellow, C.I. Pigment Yellows 12, 13, 14, 15, 17, 62, 74, 83, 93, 94, 95, 109, 110, 111, 128, 129, 147, 168, 180, 185 and the like, Food Color Green No. 3 (Fast Green FCF, C.I. No. 42053), Phthalocyanine Green, Food Color Blue No. 1 (Brilliant Blue FCF, C.I. No. 42090), Food Color Blue No. 2 (Indigo Carmine, C.I. No. 73015), Malachite Green, Methylene Blue Chloride, Phthalocyanine Blue, C.I. Pigment Blue 1, 7, 15:1, 15:2, 15:3, 15:4, 60, 62, 66 and the like. These colorants may be used singly or in combination.

The content of the colorants in the electrophotographic color toner is preferably from 0.1 to 20 parts and more preferably from 0.5 to 10 parts relative to 100 parts of the electrophotographic color toner in terms of capable of forming an image having good chroma.

[Binder Resin]

The binder resin is not particularly limited, and may be appropriately selected from well known binder resins, and for example includes thermoplastic resins such as a natural polymer, a synthetic polymer and the like, specifically, suitably including a styrene-acrylic resin, an epoxy resin, a polyether polyol resin, a polyester resin, a cycloolefin resin such as polyethylene, polypropylene and the like, a polyacrylic resin, a polyamide resin, a polyvinyl resin, a polyurethane resin, a polybutadiene resin and the like, and also including waxes such as an ester wax, a carnauba wax, a Fischer Tropsch wax, a paraffin wax, and a rice wax. These may be used singly or in combination.

The content of the binder resin in the electrophotographic color toner is preferably from 60 to 95 parts, more preferably from 75 to 95 parts relative to 100 parts of the electrophotographic color toner.

[Additives]

The additive includes at least any of burned fine particle selected from titanium oxide fine particle and tin oxide fine particles obtained by a burning process, and also includes other components as necessary.

Burned Fine Particles

The burned fine particles in the present invention are at least any fine particles selected from titanium oxide fine particles and tin oxide fine particles, and are hard to be aggregated, containing only small amount of fine particles in an aggregated state. Therefore, even when added to the toner, the leak of the toner charge caused by the presence of the aggregate will not occur. These burned fine particles have a high aspect ratio and a needle-shape to form a large number of contact points among the fine particles, so that addition of only a small amount of them will provide effective reduction of the electrical resistance of toner. Consequently, as only a low addition quantity is enough, high chroma may be achieved without making the electrophotographic color toner opaque.

The process for producing the titanium oxide fine particles and the tin oxide fine particles includes, other than the burning process, a wet process (for example, described in Japanese Patent Laid-Open No. 07-175258, No. 07-225489 and the like), a vapor-phase process (for example, described in Japanese Patent Laid-Open No. 58-1157, No. 59-52255 and the like). However, the burned fine particles such as titanium oxide fine particles and tin oxide fine particles obtained by the burning process contains an extremely small amount of aggregate compared with those obtained by the wet process or the vapor-phase process.

The burned fine particles can be prepared in the following manner.

For example, the preparation of the titanium oxide fine particles by the burning process will include the following steps. First, needle-shaped titanium oxide cores may be obtained through the following steps of: burning titanium raw materials such as titanium dioxide pigments, titanium hydroxide, dried grinds of titanium dioxide sol, rutile sand and synthesized rutile together with NaCl powder, $Na_2HPO_4$ powder and the like generally at 700 to 1000° C., preferably at 800 to 900° C. to synthesize needle-shaped titanium dioxide (burned product) having a rutile-type crystal; and charging the burned products into water, filtering and washing them to remove soluble salts, followed by drying. The resultant titanium oxide cores are added with deionized water to form an aqueous suspension, heated to 80 to 100° C., preferably from 90 to 100° C., added with a tin chloride solution and an antimony chloride aqueous solution, and maintained at a pH of 2 to 7. The suspension is filtered, washed and dried to prepare titanium dioxide fine particles having a tin oxide conductive layer containing antimony oxide formed on the surface of the titanium cores.

The burning temperature for preparing the burned fine particles according to the present invention is generally in the range of the above-described temperature, that is, preferably from 700 to 1000° C., more preferably from 800 to 900° C.

The burning temperature below 700° C. may form short and poor needle-shaped crystals, and the temperature above 1000° C. may cause the aggregation of the burned fine particles.

As for the content of the aggregated particles in the burned fine particles, the content of the particles in an aggregated state having a volume average particle diameter ($D_{50}$) of 10 μm or more is preferably 20 weight % or less, more preferably 15 weight % or less relative to the burned fine particles, particularly in terms of capable of obtaining the electrophotographic color toner that may form an image excellent in image quality and chroma, has appropriately low resistance values and does not cause failure of an image forming device or the like.

The content above 20 weight % may cause adhesion in the image forming device such as a photoreceptor or the like, or may make an electrophotographic color toner opaque when forming images.

In the present invention, the content of the aggregated particles in the burned fine particles can be measured as described below.

<Method for Measuring the Content of Aggregated Particles>

One part of the burned fine particles is accurately measured (mass=$W_0$), dissolved in 100 parts of an organic solvent (tetrahydrofuran) and ultrasonically stirred for five minutes. Further, the solution is centrifuged to precipitate only the aggregate of the burned fine particles. Supernatant liquid is discarded; the resultant solution is dried for five hours at 120° C.; and the weight of the precipitate (mass=W) is measured. The content (weight %) of the aggregated particles is calculated by $W/W_0 \times 100$.

Preferably, the volume resistivity of the burned fine particles is specifically from 1 to 100 Ωcm, more preferably from 1 to 50 Ωcm in terms of capable of obtaining good charging properties.

The volume resistivity below 1 Ωcm may reduce surface resistance of toner to prevent formation of electrophotographic color toner having a sufficient toner charge-to-mass ratio, while the volume resistivity above 100 Ωcm may require the increase of the quantity of conductive fine particles to be added up to 20 weight % or more relative to the total electrophotographic color toner, resulting in a loss of clearness of color of the electrophotographic color toner to prevent obtaining a printed image with high chroma.

The volume resistivity was measured according to the following measuring method in the present invention.

<Method for Measuring Volume Resistivity>

Burned fine particles are compression molded at a pressure of 100 kg/cm$^2$ to form a cylindrical compact (having a diameter of 20 mm and a thickness of 1 to 5 mm). Its direct current resistance is measured, and the volume resistivity is calculated according to (1) below. The volume resistivity (Ωcm) is measured using HV-MEASURE UNIT (KEITHLEY 237).

$$\text{Volume Resistivity } (\Omega\text{cm}) = \text{Measured Value} \times (\text{Sectional Area/Thickness}) \quad (1)$$

The shape of the burned fine particles is not particularly limited, but the more elongated shape is the more preferable in terms of capable of exerting the effect of the present invention. Further, the larger aspect ratio is the more preferable in terms of being effective in reducing the electrical resistance of toner by a small addition quantity. The aspect ratio is preferably 10 or more, more preferably 15 or more in terms of reducing resistance. In addition, the average length of the major axis diameter is preferably 5 μm or less, more preferably 4 μm or less in terms of dispersibility.

According to the present invention, particularly in terms of extreme effectiveness in controlling the resistance values of electrophotographic color toner, the fine particle that is needle-shaped and has the major axis diameter of 1 μm or more and the minor axis diameter of 0.1 μm or less is most preferably included in 50 weight % or more of the total burned fine particles. Inclusion of the burned fine particles in the above-described conditions can achieve good developing properties and forms more vivid images.

Further, in the case the burned fine particle is titanium dioxide fine particle, the titanium dioxide fine particle that has a conductive layer including tin oxide ($SnO_2$) and antimony oxide ($Sb_2O_3$) on the surface can achieve particularly good developing properties and vivid images, because the conductive layer is effective particularly to control resistance to further suppress the quantity to be added. The quantity of antimony oxide in the conductive layer is preferably from 10 to 25 weight % as $Sb_2O_3$ relative to $SnO_2$ in terms of capable of achieving good developing properties and vivid images. Within this range, particularly, the resistance of titanium oxide may be controlled to the lowest.

Further, in the case the burned fine particle is tin oxide fine particle, the tin oxide fine particle that has a conductive layer including antimony oxide ($Sb_2O_3$) on the surface can achieve particularly good developing properties and vivid images, because the conductive layer is effective particularly to control resistance to further suppress the quantity to be added.

Other Components

As the above-described additives, the electrophotographic color toner according to the present invention can appropriately include other additives than the burned fine particles, for example, conductive fine particles, infrared ray absorbing agents, charge control agents, flowability improving agents, cleaning active agents, magnetic materials, fixation additives, metallic soaps and surfactants.

The conductive fine particles are most preferably white conductive fine particles in terms of capable of achieving good developing properties and vivid images. The material of the white conductive fine particles preferably includes, for example, ZnO, $TiO_2$, $SnO_2$, $Al_2O_3$, $In_2O_3$, $SiO_2$, MgO, BaO, $MoO_3$, WO, $MoO_3$, particularly in terms of having small influence to the color of electrophotographic color toner.

Preferably, the volume resistivity of the white conductive fine particles is specifically from 1 to 100 Ωcm, more preferably from 1 to 50 Ωcm in terms of capable of obtaining good charging properties.

The volume resistivity of below 1 Ωcm may reduce surface resistance of toner to prevent formation of electrophotographic color toner having sufficient toner charge-to-mass ratio, while the volume resistivity above 100 Ωcm may require the increase of the quantity of conductive fine particles to be added up to 20 weight % or more relative to the total electrophotographic color toner, resulting in a loss of clearness of color of the electrophotographic color toner to prevent obtaining a printed image with high chroma.

The volume resistivity of the white conductive fine particles can be measured by a method for measuring the volume resistivity similar to that described in the "Burned fine particles".

The infrared ray absorbing agents may include any materials having at least one strong light-absorbing peak in the near infrared region of from 750 to 1200 nm, and may include both inorganic and organic infrared ray absorbing agents.

The inorganic infrared ray absorbing agents include, for example, lanthanide compounds such as ytterbium oxide and ytterbium phosphate, indium tin oxide, tin oxide and the like.

The organic infrared ray absorbing agents include, for example, aluminum compounds, diimonium compounds, naphthalocyanine compounds, cyanine compounds, polymethyne compounds and the like.

These may be used singly or in combination.

The content of the infrared ray absorbing agents in the electrophotographic color toner is preferably from 0.1 to 1.5 weight %, more preferably from 0.3 to 1 weight %.

The content of below 0.1 weight % may prevent fixing of the electrophotographic color toner, while that of above 1.5 weight % may cause opaqueness of the images to be formed.

The charge control agents are not particularly limited but can be appropriately selected from well-known charge control agents depending on the purpose, and include well-known positively charged and negatively charged charge control agents, for example, calixarenes, nigrosine dyes, quaternary ammonium salts, amino group-containing polymers, metal-containing azo dyes, salicylic acid complex compounds, phenol compounds, azochrome compounds, azo-zinc compounds, triphenylmethane derivatives, boron complexes, sonaphtoya acid zinc complexes, and carboxylic acid compounds. These may be used singly or in combination.

The flowability improving agents are not particularly limited but can be appropriately selected from well-known flowability improving agents depending on the purpose, and for example include external additives such as inorganic fine particles to be coated (externally added) on toner surfaces.

The particle diameter of the external additives (number average particle diameter ($D_{50}$)) is preferably from 5 nm to 2 μm, more preferably from 5 nm to 500 nm. The specific surface area by a BET method is preferably from 20 $m^2/g$ to 500 $m^2/g$.

The external additives are preferably compounded in the electrophotographic color toner in an amount of from 0.1 to 5 parts relative to 100 parts of electrophotographic color toner, more preferably from 0.1 to 2.0 parts.

The external additives include, for example, fine particles of silica, alumina, titanium oxide, barium titanate, magnesium titanate, calcium titanate, strontium titanate, zinc oxide, silica sand, clay, mica, wollastonite, silious earth, chromium oxide, cerium oxide, red iron oxide, antimony trioxide, magnesium oxide, zirconium oxide, barium sulfate, barium carbonate, calcium carbonate, silicon carbide, silicon nitride and the like. Silica fine particles are used most preferably among them. The surface of the external additive is preferably treated to a hydrophobic surface. These external additives may be used singly or in combination.

The cleaning active agents are not particularly limited but may be appropriately selected from well-known cleaning active agents depending on the purpose, and for example include metal salts of higher aliphatic acids represented by zinc stearate and the like, fine particle powder of fluoropolymers and the like.

The magnetic materials are not particularly limited but can be appropriately selected from well-known magnetic materials depending on the purpose, and for example include iron powder, magnetite, ferrite and the like. Particularly, when the electrophotographic color toner according to the present invention is used as a color toner, white magnetic powder is preferably used in terms of color.

The surfactants include for example nonionic surfactants.

The method for producing the electrophotographic color toner is not particularly limited but can be appropriately selected from the well-known methods, and for example includes a mechanical grinding method and the like. The mechanical grinding method has the steps of: uniformly mixing the burned fine particles with toner materials such as a binder resin, a wax component, colorants (pigment and the like) and other various additives (infrared ray absorbing agents, charge control agents, magnetic substances and the like) using a mixing apparatus such as a ball mill and a Henschel Mixer; melting, kneading, and milling using a heat-kneading apparatus such as a heat roll, a pressure kneader and an extruder to compatibilize the resins with each other and to disperse or melt metallic compounds, pigments, dyes and magnetic substances; cooling and solidifying the mixture; grinding the mixture using a grinding apparatus such as a jet mill; and classifying the ground product into a desired particle distribution with a wind classifier.

During the mixing, the burned fine particles may be dispersed uniformly in the form of primary particles in the binder resin, so that the content of aggregate is reduced to provide the electrophotographic color toner that has low resistance and is capable of forming images excellent in image quality and chroma. Thus, the electrophotographic color toner having a feature in which the burned fine particles are internally added into the electrophotographic color toner can be obtained.

In the above-described production method, the toner materials such as a binder resin, a wax component, colorants (pigment and the like) and other various additives (infrared ray absorbing agents, charge control agents, magnetic substances and the like) may first be used to mix, melt, knead, mill, cool and solidify, grind and classify, and then the burned fine particles may be added to the surface of the toner particles together with other external additives. Thus, the electrophotographic color toner having a feature in which the burned fine particles are externally added to the electrophotographic color toner can be obtained.

Most preferably, in the present invention, internal addition of the burned fine particles can particularly control the electrical resistance of the electrophotographic color toner in a wide range while maintaining high chargeability without influencing the toner charge.

The volume resistivity of the above-described electrophotographic color toner according to the present invention is preferably from $20\times10^9$ to $60\times10^9$ (Ωcm), and more preferably from $30\times10^9$ to $50\times10^9$ (Ωcm) in terms of capable of preferably forming images having good image quality and chroma.

In the present invention, the volume resistivity of the electrophotographic color toner can be measured according to the measuring method described below.

<Method for Measuring Volume Resistivity of Electrophotographic Color Toner>

Electrophotographic color toner particles are compression molded at a pressure of 5000 kg/cm$^2$ to form a cylindrical compact (having a diameter of 13 mm and a thickness of 200 to 500 μm). The conductance of the compact was measured using a dielectric loss measuring device (made by Ando Electric Co., Ltd.), and the volume resistivity was determined by (2) below:

$$\text{Volume Resistivity}(\Omega\cdot\text{cm}) = \frac{S}{L\cdot d} \tag{2}$$

wherein S denotes the bottom surface area of the cylindrical compact (cm$^2$); d denotes the thickness of the cylindrical compact (cm) and L denotes the conductance of the compact ($\Omega^{-1}$).

As for the content of the aggregated particles in the total electrophotographic color toner according to the present invention as described above, the content of the aggregated particles having a volume average particle diameter ($D_{50}$) of 10 μm or more is preferably 1 weight % or less, more preferably 0.2 weight % or less relative to the total electrophotographic color toner, particularly in terms of capable of obtaining the electrophotographic color toner that may form an image excellent in image quality and chroma, has low resistance values and does not cause failure of an image forming device or the like.

Particularly, when the burned fine particles are internally added to the electrophotographic color toner, the content of the burned fine particles of preferably 1 weight % or less, more preferably 0.9 weight % or less relative to the total electrophotographic color toner, in terms of capable of obtaining the electrophotographic color toner that may form an image excellent in image quality and chroma, has low resistance values and does not cause failure of an image forming device or the like. In addition, the burned fine particles to be externally added to the electrophotographic color toner is, from a similar viewpoint, preferably 0.2 weight % or less and more preferably 0.15 weight % or less relative to the total electrophotographic color toner.

In the present invention, the quantity of the aggregated particles relative to the total electrophotographic color toner can be measured as described below.

<Method for Measuring the Quantity of Aggregated Particles>

One part of the electrophotographic color toner is accurately measured (mass=$W_1$), dissolved in 100 parts of an organic solvent (tetrahydrofuran) and ultrasonically stirred for five minutes. Further, the solution is centrifuged to precipitate only the aggregated particles. Supernatant liquid is discarded; the resultant solution is dried for 5 hours at 120° C.; and the weight of the precipitate (mass=W) is measured. The content (weight %) of the aggregated particles is calculated by $W/W_1\times100$.

The above-described electrophotographic color toner according to the present invention particularly has a low resistance of the same level as that of monochrome toner, forms the image having no opaqueness, is excellent in image quality and chroma, does not cause any image degradation due to the leak of toner charge caused by the aggregation and the device failure or the like due to adherence to a charging device or a transfer device, and can stably form images having vivid color. Thus, the electrophotographic color toner according to the present invention can suitably be used for a copying machine, a printer, a facsimile and the like in a conventional electrophotographic system, and in particular can suitably be used for the electrophotographic color developer, the toner cartridge, the device and the method for image forming according to the present invention described below.

Electrophotographic Color Developer

The electrophotographic color developer according to the present invention at least includes the electrophotographic color toner according to the present invention and includes appropriately selected other components as necessary.

The electrophotographic color developer may be a one-component developer including the electrophotographic color toner or a two-component developer including the electrophotographic developer and a carrier. Preferably, the electrophotographic color developer is the two-component developer in terms of extending life when used in high-speed printers corresponding to the recent improvement in the speed of information processing.

Carrier

The carrier is not particularly limited but may be appropriately selected depending on the purpose, and preferably has a core and a resin layer that coats the core.

Materials for the core preferably include, for example, manganese-strontium (Mn—Sr)-based materials, manganese-magnesium (Mn—Mg)-based materials and the like of from 50 to 90 emu/g, high magnetization materials such as iron powder (100 emu/g or more) and magnetite (75 to 120 emu/g) in terms of securing image intensity, and low magnetization materials such as copper-zinc (Cu—Zn)-based materials (30 to 80 emu/g) in terms of capable of reducing touching force to the photoreceptor in which the toner is in a napped state and being advantageous for providing high quality images. These can be used singly or in combination.

The core materials have an average particle diameter of (volume average particle diameter ($D_{50}$)) preferably from 10 to 50 $\mu$m, more preferably from 40 to 100 $\mu$m.

The average particle diameter (volume average particle diameter ($D_{50}$)) of below 10 $\mu$m may increase fine particles in the distribution of carrier particles to reduce the magnetization per one particle to scatter the carrier, and above 150 $\mu$m may reduce a specific surface area to scatter toner to deteriorate reproduction of the solid part in the full-color having a large solid part.

Materials for the resin layer are not particularly limited but may be appropriately selected from well-known materials depending on the purpose, and suitably include silicone resins such as a silicone resin, an acrylic-modified silicone resin and a fluoro-modified silicone resin in terms of durability, long life and the like. These may be used singly or in combination.

The method for forming the resin layer may include, for example, dissolving the silicone resin or the like in a solvent to prepare a coating solution; uniformly applying the coating solution on the surface of the core material by a well-known method, for example, dipping, spraying, brushing or the like; and drying, followed by baking.

The solvent is not particularly limited but can be appropriately selected depending on the purpose, and may include, for example, toluene, xylene, methyl ethyl ketone, methyl isobutyl ketone, butyl cellosolve acetate and the like.

The baking may be an external heating type or an internal heating type, and may include, for example, methods for using a fixed electric furnace, a fluidized electric furnace, a rotary electric furnace, a burner furnace and the like, and a method for using microwave and the like.

The rate of the resin layer in the carrier (amount of resin coating) is preferably from 0.01 to 5.0 weight % relative to the total carrier.

The rate (amount of resin coating) of less than 0.01 weight % may fail to form a uniform resin layer on the surface of the core material, and above 5.0 weight % may result in the resin layer having too much thickness to cause size enlargement between carriers, preventing to obtain uniform carriers.

When the electrophotographic color developer is the two-component developer, the content of the carrier in the two-component developer is not particularly limited but may be appropriately selected depending on the purpose, and is preferably, for example, from 90 to 98 weight %, more preferably from 93 to 97 weight %.

The electrophotographic color developer according to the present invention includes the electrophotographic color toner according to the present invention, so that it has suitable resistance value, is capable of forming images excellent in image quality and chroma, and causes no failure of the image-forming device and the like to be used. The electrophotographic color developer according to the present invention can be used for forming images by various well-known electrophotographic methods such as a magnetic one-component developing method, a non-magnetic one-component developing method and a two-component developing method, and can particularly suitably used for the following image forming method and the image forming device according to the present invention.

Toner Cartridge

The toner cartridge according to the present invention is a component suitably removable from the image forming device according to the present invention to be described below, and at least contains the electrophotographic color toner according to the present invention. Thus, it may be mounted particularly on the image forming device and the like according to the present invention to be described below to effectively form images excellent in image quality and chroma.

Method and Device for Image Forming

The image forming method according to the present invention at least includes an electrostatic latent image forming step, a developing step and a transfer step, preferably further includes a fixing step, and may include other appropriately selected steps as necessary, for example, a diselectrifying step, a cleaning step, a recycle step and a control step.

The image forming device according to the present invention at least have an electrostatic latent image carrier, electrostatic latent image forming means, developing means and transfer means, preferably further has fixing means, and may have other appropriately selected means as necessary, for example, diselectrifying means, cleaning means, recycle means and control means.

The image forming method according to the present invention can be suitably carried out by the image forming device according to the present invention; the electrostatic latent image forming step can be carried out by the electrostatic latent image forming means; the developing step can be carried out by the developing means; the transfer step can be carried out by the transfer means; the fixing step can be carried out by the fixing means; and the other steps can be carried out by the other means.

Step and Means for Forming Electrostatic Latent Image

The electrostatic latent image-forming step is the step for forming electrostatic latent images on an electrostatic latent image carrier.

The electrostatic latent image carrier (also called "photoconductive insulator" or "photoreceptor") is not particularly limited in terms of its material, shape, structure, size and the like, but may be appropriately selected from well-known electrostatic latent image carriers. The shape suitably includes a drum shape, and the material includes, for example, inorganic photoreceptors such as amorphous silicon and selenium and organic photoreceptor such as polysilane and phthalocyanine.

The electrostatic latent image can be formed, for example, by uniformly charging the surface of the electrostatic latent image carrier and then image-wise exposing the surface, and can be formed with the electrostatic latent image forming means.

The electrostatic latent image forming means at least has a charging device that uniformly charges the surface of the electrostatic latent image carrier and an exposing device that image-wise exposes the surface of the electrostatic latent image carrier.

The charging can be conducted by applying voltage to the surface of the electrostatic latent image carrier using the charging device.

The charging device is not particularly limited but may be appropriately selected depending on the purpose, and includes, for example, well-known contact charging devices having a conductive or semi-conductive roll, brush, film, or rubber blade, and non-contact charging device applying corona discharge such as a corotron and a scorotron.

The exposing can be carried out, for example, by image-wise exposing the surface of the electrostatic latent image carrier using the exposing device.

The exposing device is not particularly limited as long as it is capable of exposing, image-wise to be formed, the surface of the electrostatic latent image carrier that is charged with the charging device, but may be appropriately selected depending on the purpose, and includes various exposing devices, for example, a copying optical system, a rod-lens array system, a laser optical system, a liquid crystal shutter optical system and the like.

The present invention may adopt a back-exposure type for image-wise exposing from the back-surface side of the electrostatic latent image carrier.

Developing Step and Developing Means

The developing step is that for developing the electrostatic latent image using an electrophotographic color developer to form a visible image.

The visible image may be formed by, for example, developing the electrostatic latent image using the electrophotographic color developer, and may be formed with the developing means. The developing means contains the electrophotographic color developer, and at least has a developing device for imparting the electrophotographic color developer to the electrostatic latent image contactly or non-contactly.

The developing device may be of a dry-developing type or a wet-developing type, and may be a monochromatic color developing device or a multiple color developing device, and suitably includes, for example, the one having a stirrer for frictionally stirring to charge the electrophotographic color developer and a rotatable magnet roller.

In the developing device, for example, the electrophotographic color toner is mixed and stirred with the carrier, and the electrophotographic color toner is charged by the friction at the mixing and stirring, being held in a napped state on the surface of a rotating magnet roller to form a magnetic brush. The magnet roller is disposed near the electrostatic latent image carrier (photoreceptor), so that part of the electrophotographic color toner composing the magnetic brush formed on the surface of the magnet roller is transferred to the surface of the electrostatic latent image carrier (photoreceptor) by electric forces of attraction. Consequently, the electrostatic latent image is developed by the electrophotographic color toner to form a visible image of the toner on the surface of the electrostatic latent image carrier (photoreceptor).

The developer to be contained in the developing device is the electrophotographic color developer according to the present invention, which may be a one-component developer or a two-component developer. The toner included in the electrophotographic color developer is the electrophotographic color toner according to the present invention. For monochromatic developing, a black toner is generally used; for multiple color developing, other than the black toner, a chromatic color toner selected from magenta toner, yellow toner and cyan toner is used; and for full color, a black toner, magenta toner, yellow toner and cyan toner are used.

Transfer Step and Transfer Means

The transfer step is the step for transferring the visible image to a transfer material.

The transfer of the visible image may be conducted by using a transfer/charging device having reverse polarity to the electrophotographic color toner, and may be conducted with the transfer means.

The transfer means at least has a transfer device that releases and charges the visible image formed on the electrostatic latent image carrier (photoreceptor) to the transfer material side.

The transfer device includes a corona transfer device using corona discharge, a transfer belt, a transfer roller, a pressure transfer roller and an adhesive transfer device.

The transfer material is not particularly limited but can be appropriately selected from well-known recording media (recording paper).

Fixing Step and Fixing Means

The fixing step is the step for fixing the transfer image transferred to the transfer material using a fixing device.

The fixing may be heat/pressure fixing of the transfer image transferred to the transfer material by using a fusing roller. Preferably, the fixing is the light-fixing and may be conducted with the fixing means.

The light-fixing may be conducted by the irradiation of light using a light-fixing device to the transfer image transferred to the transferred material, and may be conducted with a light-fixing means.

The light-fixing means at least has a flash lamp for irradiating infrared ray.

The flash lamp is not particularly limited but can be appropriately selected depending on the purpose, and suitably includes, for example, an infrared ray lamp, a xenon lamp and the like.

The flash energy in the light-fixing is preferably approximately from 1 to 3 $J/cm^2$.

The flash energy of below 1 $J/cm^2$ may prevent good fixing, while above 3 $J/cm^2$ may produce toner voids, the burn of paper or the like.

The diselectrifying step is the step that conducts diselectrification by overall exposing or applying diselectrifying bias to the electrostatic latent image carrier, and may suitably be conducted with diselectrifying means.

The diselectrifying means is not particularly limited but can be appropriately selected from well-known diselectrifying devices as long as the exposure or the diselectrifying bias can be applied to the electrostatic latent image carrier.

The cleaning step is the step that removes the electrophotographic toner remaining on the electrostatic latent image carrier, and may be suitably conducted with cleaning means.

The cleaning means is not particularly limited but may be appropriately selected from well-known cleaners as long as the electrophotographic toner remaining on the electrostatic latent image carrier may be removed, and suitably includes, for example, a magnetic brush cleaner, an electrostatic brush cleaner, a magnetic roller cleaner, a blade cleaner, a brush cleaner, a web cleaner and the like.

The recycle step is the step in which the electrophotographic color toner removed at the cleaning step is recycled to the developing means, and may be suitably conducted with recycle means.

The recycle means is not particularly limited but may include well-known carrying means and the like.

The control means is not particularly limited as long as it can control the movement of the above-described means and can be appropriately selected depending on the purpose, and may include equipment such as a sequencer and a computer.

In the image forming method according to the present invention, an electrostatic latent image is formed on an electrostatic latent image carrier in the electrostatic latent image-forming step. In the developing step, the electrostatic latent image is developed by the electrophotographic color developer to form a visible image. In the transfer step, the visible image is transferred to a transfer material. The transferred image transferred to the transfer material is fixed in the fixing step. Consequently, an image is formed on the transfer material. Consequently, the image is fixed in extremely high speed and formed on the transfer material.

In addition, in the image forming device according to the present invention, the electrostatic latent image forming means forms an electrostatic latent image on an electrostatic latent image carrier. The developing means contains the electrophotographic color developer, and develops the electrostatic latent image to form a visible image. The transfer means transfers the visible image to a transfer material. The fixing means fixes the transferred image transferred to the transfer material. Consequently, the image is fixed in extremely high speed and formed on the transfer material.

The device and method for image forming use the electrophotographic color developer according to the present invention including the electrophotographic color toner according to the present invention as the electrophotographic color developer, thereby capable of effectively forming images excellent in image quality and chroma.

The image forming device according to the present invention will be schematically described referring to FIG. 1. An image forming device 1 has a photoreceptor 10 and sequentially has a charging device 20, exposure means 30, developing means 40, a transfer device 50, a cleaner 60 and a diselectrifying device 70 around the photoreceptor 10, and further has a flash fixing device 80 having a xenon flash lamp 81. The developing means 40 has a developer container 41, a developing roller 43, a non-illustrated agitation blade and the like, and is adapted to bring electrophotographic color toner particles TO into contact with carrier particles CA in the developer container 41, imparting a specific amount of charge to the electrophotographic color toner. In the image forming device 1, the electrophotographic color toner is preset in a toner hopper 45 and added into the developer container 41 from the toner hopper 45 when the toner concentration in the developer container 41 is reduced associated with printing. The electrophotographic color toner to be set in the toner hopper 45 and the developer container 41 may be appropriately changed to print with toner having various colors.

The image forming device is not particularly limited but is preferably of a high-speed developing type having a process speed of approximately 1100 mm/s, and preferably has a photoreceptor including amorphous silicon.

EXAMPLES

The present invention will now be described further in detail referring to Examples, but will not be limited by the Examples, described below.

<Preparation (by Burning Process) of Burned Fine Particles (Needle-shaped Titanium Dioxide (a))>

Preparation of Titanium Oxide Core

Forty parts of dried grinds of titanium dioxide sol (based on $TiO_2$), 40 parts of NaCl powder and 10 parts of $Na_2HPO_4$ powder were uniformly mixed, charged in a crucible and burned for 3 hours at 825° C. in an electric furnace. The burned product was then charged into deionized water, boiled for 1 hour, filtered and washed to remove soluble salts, and then dried to obtain needle-shaped titanium dioxide (titanium oxide core) having a uniform particle diameter, well-grown major and minor axes, a major axis diameter of from 2 to 7 μm (average 4 μm), a minor axis diameter of from 0.1 to 0.6 μm and an aspect ratio of 12.

Coating of Conductive Layer

One hundred parts of the resultant needle-shaped titanium dioxide was dispersed in deionized water to prepare an aqueous suspension of titanium oxide. Next, 150 g of tin chloride ($SnCl_4.5H_2O$) and 25 g of antimony chloride ($SbCl_3$), which were adjusted to a pH of from 2 to 3 with a HCl aqueous solution and a NaOH aqueous solution, were added to the aqueous suspension of titanium oxide to coat the surface of the needle-shaped titanium dioxide (titanium oxide core) with the hydrates of tin oxide and antimony oxide. Then, the aqueous suspension of titanium oxide was filtered, washed and dried to obtain the needle-shaped titanium dioxide (a).

Measurement of Volume Resistivity and Aggregated Particle Content of Needle-shaped Titanium Dioxide (a)

The volume resistivity of the obtained burned fine particles (needle-shaped titanium dioxide (a)) was measured according to the following measuring method to be 7.0 Ωcm. The content (weight %) of the particles in an aggregated state having a volume average particle diameter ($D_{50}$) of 10 μm or more in the obtained burned fine particles (needle-shaped titanium dioxide (a)) was measured according to the following measuring method to be 7.8 weight %.

<<Method for Measuring Volume Resistivity>>

The burned fine particles are compression molded at a pressure of 100 kg/cm$^2$ to form a cylindrical compact (having a diameter of 20 mm and a thickness of 1 to 5 mm). Its direct current resistance is measured, and the volume resistivity is calculated according to (1) below. The volume resistivity (Ωcm) is measured using HV-MEASURE UNIT (KEITHLEY 237).

$$\text{Volume Resistivity } (\Omega\text{cm}) = \text{Measured Value} \times (\text{Sectional Area}/\text{Thickness}) \quad (1)$$

<<Method for Measuring the Content of Aggregated Particles in Burned Fine Particles>>

One part of the burned fine particles is accurately measured (mass=$W_0$), dissolved in 100 parts of an organic solvent (tetrahydrofuran) and ultrasonically stirred for five minutes. Then, the solution is centrifuged to precipitate only the aggregate of the burned fine particles. Supernatant liquid is discarded; the resultant solution is dried for 5 hours at 120° C.; and the weight of the precipitate (mass=W) is measured. The content (weight %) of the aggregated particles is determined by calculation using $W/W_0 \times 100$.

<Preparation (by Wet Process) of Burned Fine Particles (Needle-shaped Titanium Oxide (b))>

Preparation of Titanium Oxide Core

Ninety parts of titanium tetrachloride was charged into 100 parts of deionized water, to which an aqueous solution of ammonium sulfate was added. The resultant solution was boiled at 70 to 90° C., cooled, brought into contact with ammonia water and aged at a pH of 8.5 to obtain needle-shaped fine particles. The fine particles were washed with deionized water and dried at 250° C. to obtain the needle-shaped titanium oxide (titanium oxide core) having a major axis diameter of from 2 to 7 μm (average 4 μm), a minor axis diameter of from 0.2 to 0.6 μm and an aspect ratio of 13.

Coating of Conductive Layer, Measurement of Volume Resistivity and Content of Aggregated Particles A conductive layer was coated in a manner similar to "Preparation of needle-shaped titanium dioxide (a)" to obtain the needle-shaped titanium oxide (b). The volume resistivity (Ωcm) of the obtained needle-shaped titanium oxide (b) was measured in a manner similar to "Preparation of needle-shaped titanium dioxide (a)" to be 7.0 Ωcm. Further, the content (weight %) of the particles in an aggregated state having a volume average particle diameter ($D_{50}$) of 10 μm or more was measured in a manner similar to "Preparation of needle-shaped titanium dioxide (a)", and the content of the titanium oxide aggregate having a volume average particle diameter ($D_{50}$) of 10 μm or more was 24.3 weight %.

Example 1

Preparation of Electrophotographic Color Toner

Composition of Toner Matrix

Binder resin: polyester resin (a condensate of a bisphenol A ethylene oxide 2.2 mole adduct with terephthalic acid, Mn=4000, Mw=12000) . . . 100 parts Colorant: C.I. Pigment Red 57:1 . . . 4 parts Charge control agent: E-81 (made by Orient Chemical Industries, Ltd.) . . . 1 part Resistance adjusting agent (needle-shaped titanium dioxide (a) obtained by a burning process) . . . 5 parts The above composition was melt-kneaded, ground and classified to obtain a toner matrix having a volume average diameter ($D_{50}$) of 8 μm.

Subsequently, the composition below was mixed and agitated with a Henschel Mixer to obtain the electrophotographic color toner of magenta color. The volume resistivity of the obtained electrophotographic color toner was measured according to the following measuring method to be $40\times10^{9}$ Ωcm. The quantity of the particles (titanium oxide particles) in an aggregated state having a volume average diameter ($D_{50}$) of 10 μm or more relative to the total electrophotographic color toner was measured according to the following measuring method to be 0.4 weight %. The results are shown in Table 1.

Composition of Electrophotographic Color Toner

The toner matrix . . . 100 parts

Hydrophobic silica (H2000/4, made by Clariant AG) . . . 1 part

<<Method for Measuring Volume Resistivity of Electrophotographic Color Toner>>

Electrophotographic color toner particles are compression molded at a pressure of 5000 kg/cm$^2$ to form a cylindrical compact (having a diameter of 13 mm and a thickness of 200 to 500 μm). The conductance of the compact was measured using a dielectric loss measuring device (made by Ando Electric Co., Ltd.), and the volume resistivity is determined by (2) below:

$$\text{Volume Resistivity}(\Omega\cdot\text{cm}) = \frac{S}{L\cdot d} \tag{2}$$

In (2), "S" denotes the bottom surface area of the cylindrical compact (cm$^2$); "d" denotes the thickness of the cylindrical compact (cm) and "L" denotes the conductance of the compact ($\Omega^{-1}$).

<<Method for Measuring the Quantity of Aggregated Particles Relative to the Total Electrophotographic Color Toner>>

One part of electrophotographic color toner is accurately measured (mass=$W_1$), dissolved in 100 parts of an organic solvent (tetrahydrofuran) and ultrasonically stirred for 5 minutes. Further, the solution is centrifuged to precipitate only the aggregated particles. Then, supernatant liquid is discarded; the resultant solution is dried for 5 hours at 120° C.; and the weight of the precipitate (mass=W) is measured. The content (weight %) of the aggregated particles in the electrophotographic color toner is calculated by $W/W_1\times100$.

Preparation of Two-component Developer, Measurement of Charge, Evaluation of Developing Property and Stability by a Printing Test, Evaluation of Chroma and the Like Five parts of the obtained electrophotographic color toner and 95 parts of a silicone resin-coated magnetite carrier (made by Kanto Denka Kogyo Co., Ltd.) were mixed in a ball mill to prepare a two-component developer.

The charge of the obtained two-component developer was measured with a blow-off powder charge-measuring device (TB-200, made by Toshiba Chemical Corp.). The results are shown in Table 1.

Subsequently, a continuous printing test of one hundred thousand sheets was conducted using a color laser printer (PS2160, made by Fujitsu Limited, 140 sheets/min), and developing property, stability and chroma were evaluated. The results on the developing property and the stability are shown in Table 1.

In the evaluation of the developing property, a printing test was conducted in a similar manner using the black toner prepared in a "reference test" to be described below, and the developing property was comparatively evaluated according to the following evaluation standards based on the results of the test. In the present invention, "Excellent" and "Good" are practically preferred levels.

Standards for Evaluating Developing Property

The case where the amount of developing that is approximately equal to that of black toner or more has been obtained: Excellent The case where the amount of developing that is less than that of black toner has been obtained, but sufficient image density has been obtained: Good The case where sufficient image density has not been obtained: Moderate The case where defects such as fog in printed images have occurred: Poor In the evaluation of the stability, the image density, the charge and the presence or absence of discharge marks to a receptor drum after the continuous printing test were studied and evaluated. "No problem" in the table denotes the fact that, after the test the image density showed no change; the change of charge was 20% or less; and the discharge marks to the receptor drum were not observed, so that this is evaluated to have high stability. "Density decrease" denotes the case where the image density decreased after the test;

"Charge up" denotes the case where the charge increased after the test; and "Drum discharge marks" denotes the case where the discharge marks were observed on the surface of the drum after the test. All of them are evaluated to have low stability. The toner density in the image after the continuous printing was measured to determine the charge, which was then compared with the charge before the continuous printing to determine the change of the charge.

In the evaluation of the chroma, the opaqueness of images was observed to evaluate.

Example 2

The electrophotographic color toner was prepared in the same manner as in Example 1 to prepare a two-component developer to conduct each measurement/evaluation, except that a mixed amount (5 parts) of a resistance adjusting agent (needle-shaped titanium dioxide (a) obtained by a burning process) was changed to 1 part in the "Composition of toner matrix" in Example 1. The results are shown in Table 1.

Example 3

The electrophotographic color toner was prepared in the same manner as in Example 1 to prepare a two-component developer to conduct each measurement/evaluation, except that a mixed amount (5 parts) of a resistance adjusting agent (needle-shaped titanium dioxide (a) obtained by a burning process) was changed to 3 parts in the "Composition of toner matrix" in Example 1. The results are shown in Table 1.

Example 4

The electrophotographic color toner was prepared in the same manner as in Example 1 to prepare a two-component developer to conduct each measurement/evaluation, except that a mixed amount (5 parts) of a resistance adjusting agent (needle-shaped titanium dioxide (a) obtained by a burning process) was changed to 7 parts in the "Composition of toner matrix" in Example 1. The results are shown in Table 1.

Example 5

The electrophotographic color toner was prepared in the same manner as in Example 1 to prepare a two-component developer to conduct each measurement/evaluation, except that a mixed amount (5 parts) of a resistance adjusting agent (needle-shaped titanium dioxide (a) obtained by a burning process) was changed to 10 parts in the "Composition of toner matrix" in Example 1. The results are shown in Table 1.

Example 6

The electrophotographic color toner was prepared in the same manner as in Example 1 to prepare a two-component developer to conduct each measurement/evaluation, except that a mixed amount (5 parts) of a resistance adjusting agent (needle-shaped titanium dioxide (a) obtained by a burning process) was changed to 20 parts in the "Composition of toner matrix" in Example 1. The results are shown in Table 1.

Comparative Example 1

The toner matrix having a volume average diameter ($D_{50}$) of 8 $\mu$m was obtained in the same manner as in Example 1 to prepare electrophotographic color toner in the same manner as in Example 1 to prepare a two-component developer to conduct each measurement/evaluation, except that a resistance adjusting agent (needle-shaped titanium dioxide (a) obtained by a burning process) was replaced with a resistance adjusting agent (needle-shaped titanium oxide (b) obtained by a wet process) in the "Composition of toner matrix" in Example 1. The results are shown in Table 1. The volume resistivity of the obtained electrophotographic color toner was $40\times10^9$ Ωcm, and the content of titanium oxide aggregate in the electrophotographic color toner was 1.3 weight %.

Comparative Example 2

The toner matrix having a volume average diameter ($D_{50}$) of 8 $\mu$m was obtained in the same manner as in Example 5 to prepare an electrophotographic color toner in the same manner as in Example 5 to prepare a two-component developer to conduct each measurement/evaluation, except that a resistance adjusting agent (needle-shaped titanium dioxide (a) obtained by a burning process) was replaced with a resistance adjusting agent (needle-shaped titanium oxide (b) obtained by a wet process) in the "Composition of toner matrix" in Example 5. The results are shown in Table 1. The volume resistivity of the obtained electrophotographic color toner was $30\times10^9$ Ωcm, and the content of titanium oxide aggregate in the electrophotographic color toner was 2.2 weight %.

Comparative Example 3

The toner matrix having a volume average diameter ($D_{50}$) of 8 $\mu$m was obtained in the same manner as in Example 1 to prepare an electrophotographic color toner in the same manner as in Example 1 to prepare a two-component developer to conduct each measurement/evaluation, except that a resistance adjusting agent (needle-shaped titanium dioxide (a) obtained by a burning process) was not used in the "Composition of toner matrix" in Example 1. The results are shown in Table 1. The volume resistivity of the obtained electrophotographic color toner was $70\times10^9$ Ωcm.

Example 7

Preparation of Electrophotographic Color Toner

Composition of Toner Matrix

Binder resin: polyester resin (a condensate of a bisphenol A ethylene oxide 2.2 mole adduct with terephthalic acid, Mn=4000, Mw=12000) . . . 100 parts Colorant: C.I. Pigment Red 57:1 . . . 4 parts Charge control agent: E-81 (made by Orient Chemical Industries, Ltd.) . . . 1 part The toner matrix composition was melt-kneaded, ground and classified to obtain a toner matrix having a volume average diameter ($D_{50}$) of 8 $\mu$m.

Subsequently, the "Composition of the electrophotographic color toner" below was mixed and agitated with a Henschel Mixer to obtain the electrophotographic color toner of magenta color. The volume resistivity of the obtained electrophotographic color toner was measured in the same manner as in Example 1 to be $40\times10^9$ Ωcm. The content of the particles (titanium oxide particles) in an aggregated state having a volume average diameter ($D_{50}$) of 10 μm or more in the electrophotographic color toner was measured in the same manner as in Example 1 to be 0.4 weight %.

Composition of Electrophotographic Color Toner

The toner matrix . . . 100 parts

Resistance adjusting agent: needle-shaped titanium dioxide (a) (obtained by a burning process) . . . 0.5 part Hydrophobic silica (H2000/4, made by Clariant AG) . . . 1 part Preparation of Two-component Developer, Measurement of Charge, Evaluation of Developing Property and Stability by a Printing Test, Evaluation of Chroma and the Like Using the obtained electrophotographic color toner, a two-component developer was prepared in the same manner as in Example 1 to conduct each measurement/evaluation in the same manner as in Example 1. The results are shown in Table 2.

Example 8

The electrophotographic color toner was prepared in the same manner as in Example 7 to prepare a two-component developer to conduct each measurement/evaluation, except that a mixed amount (0.5 part) of a resistance adjusting agent (needle-shaped titanium dioxide (a) obtained by a burning process) was changed to 0.1 part in the "Composition of toner matrix" in Example 7. The results are shown in Table 2.

Example 9

The electrophotographic color toner was prepared in the same manner as in Example 7 to prepare a two-component developer to conduct each measurement/evaluation, except that a mixed amount (0.5 part) of a resistance adjusting agent (needle-shaped titanium dioxide (a); obtained by a burning process) was changed to 0.3 part in the "Composition of toner matrix" in Example 7. The results are shown in Table 2.

Example 10

The electrophotographic color toner was prepared in the same manner as in Example 7 to prepare a two-component developer to conduct each measurement/evaluation, except that a mixed amount (0.5 part) of a resistance adjusting agent (needle-shaped titanium dioxide (a): obtained by a burning process) was changed to 0.7 part in the "Composition of toner matrix" in Example 7. The results are shown in Table 2.

Example 11

The electrophotographic color toner was prepared in the same manner as in Example 7 to prepare a two-component developer to conduct each measurement/evaluation, except that a mixed amount (0.5 part) of a resistance adjusting agent (needle-shaped titanium dioxide (a); obtained by a burning process) was changed to 1.0 part in the "Composition of toner matrix" in Example 7. The results are shown in Table 2.

Example 12

The electrophotographic color toner was prepared in the same manner as in Example 7 to prepare a two-component developer to conduct each measurement/evaluation, except that a mixed amount (0.5 part) of a resistance adjusting agent (needle-shaped titanium dioxide (a); obtained by a burning process) was changed to 2.0 parts in the "Composition of toner matrix" in Example 7. The results are shown in Table 2.

Comparative Example 4

The toner matrix having a volume average diameter ($D_{50}$) of 8 μm was obtained in the same manner as in Example 7 to prepare electrophotographic color toner in the same manner as in Example 7 to prepare a two-component developer to conduct each measurement/evaluation, except that a resistance adjusting agent (needle-shaped titanium dioxide (a) (obtained by a burning process)) was replaced with a resistance adjusting agent (needle-shaped titanium oxide (b) (obtained by a wet process)) in the "Composition of toner matrix" in Example 7. The results are shown in Table 2. The volume resistivity of the obtained electrophotographic color toner was $40\times10^{9}$ Ωcm, and the content of aggregated particles (titanium oxide aggregate) was 0.3 weight %.

Comparative Example 5

The toner matrix having a volume average diameter ($D_{50}$) of 8 μm was obtained in the same manner as in Example 11 to prepare an electrophotographic color toner in the same manner as in Example 11 to prepare a two-component developer to conduct each measurement/evaluation, except that a resistance adjusting agent (needle-shaped titanium dioxide (a) (obtained by a burning process)) was replaced with a resistance adjusting agent (needle-shaped titanium oxide (b) (obtained by a wet process)) in Example 11. The results are shown in Table 2. The volume resistivity of the obtained electrophotographic color toner was $30\times10^{9}$ Ωcm, and the content of aggregated particles (titanium oxide aggregate) was 0.5 weight %.

Comparative Example 6

The toner matrix having a volume average diameter ($D_{50}$) of 8 μm was obtained in the same manner as in Example 12 to prepare an electrophotographic color toner in the same manner as in Example 12 to prepare a two-component developer to conduct each measurement/evaluation, except that a resistance adjusting agent (needle-shaped titanium dioxide (a) (obtained by a burning process)) was replaced with a resistance adjusting agent (needle-shaped titanium oxide (b) (obtained by a wet process)) in Example 12. The results are shown in Table 2. The volume resistivity of the obtained electrophotographic color toner was $30\times10^{9}$ Ωcm, and the content of aggregated particles (titanium oxide aggregate) was 1.1 weight %.

(Reference Test)

A black toner was prepared in the same manner as in Example 1, except that 4 parts of a colorant: C.I. Pigment Red 57:1 was replaced with 10 parts of carbon black (MOGUL L, made by Cabot Corporation), and a resistance adjusting agent (needle-shaped titanium dioxide (a) obtained by a burning process) was not added. The volume resistivity of the obtained black toner was $45\times10^{9}$ Ωcm, and the charge was −20.5 μC/g.

TABLE 1

| | Method for producing titanium oxide | Added quantity (weight %) | Aggregated particles relative to total toner (weight %) | Volume resistivity ($\times 10^9$ Ωcm) | Charge (μc/g) | Developing property | Stability |
|---|---|---|---|---|---|---|---|
| Example 1 | Burning process | 5 | 0.4 | 40 | −20.4 | Excellent | No problem |
| Example 2 | Burning process | 1 | 0.1 | 60 | −20.8 | Good | No problem |
| Example 3 | Burning process | 3 | 0.2 | 50 | −20.6 | Excellent | No problem |
| Example 4 | Burning process | 7 | 0.5 | 35 | −20.4 | Excellent | No problem |
| Example 5 | Burning process | 10 | 0.6 | 30 | −20.2 | Excellent | No problem |
| Example 6 | Burning process | 20 | 0.9 | 20 | −19.8 | Excellent | No problem |
| Comparative Example 1 | Wet process | 5 | 1.3 | 40 | −10.3 | Poor | Drum discharge marks |
| Comparative Example 2 | Wet process | 10 | 2.2 | 30 | −2.5 | Poor | Drum discharge marks |
| Comparative Example 3 | — | 0 | 0 | 70 | −21.3 | Moderate | Density decrease (Charge up) |

TABLE 2

| | Method for producing titanium oxide | Added quantity (weight %) | Aggregated particles relative to total toner (weight %) | Volume resistivity ($\times 10^9$ Ωcm) | Charge (μC/g) | Developing property | Stability |
|---|---|---|---|---|---|---|---|
| Example 7 | Burning process | 0.5 | 0.03 | 40 | −19.9 | Excellent | No problem |
| Example 8 | Burning process | 0.1 | 0.01 | 60 | −21 | Good | No problem |
| Example 9 | Burning process | 0.3 | 0.01 | 50 | −20.4 | Excellent | No problem |
| Example 10 | Burning process | 0.7 | 0.05 | 35 | −19.5 | Excellent | No problem |
| Example 11 | Burning process | 1 | 0.07 | 30 | −18.1 | Excellent | No problem |
| Example 12 | Burning process | 2 | 0.12 | 20 | −17.8 | Excellent | No problem |
| Comparative Example 4 | Wet process | 0.5 | 0.3 | 40 | −3.2 | Poor | No problem |
| Comparative Example 5 | Wet process | 1 | 0.5 | 30 | −1.3 | Poor | No problem |
| Comparative Example 6 | Wet process | 2 | 1.1 | 20 | 0.8 | Poor | Drum discharge marks |

From Tables 1 and 2, it was confirmed that in Examples 1 through 12, the change rate of the toner charge-to-mass ratio was 20% or less and images having vivid color could be printed with stability in the printing test of one hundred thousand sheets.

In Comparative Examples 1 and 2, the leak of the toner charge-to-mass ratio was intense, and the occurrence of fog was observed. In addition, a large number of discharge marks were observed on the receptor drum after the continuous printing. The quantity of the aggregated particles of the conductive titanium oxide contained in the electrophotographic color toner was 1.3 weight % and 2.2 weight %, respectively, relative to the total electrophotographic color toner.

In Comparative Examples 4 through 6, the leak of the toner charge-to-mass ratio was intense, and the occurrence of fog was observed. When continuously printed, a large number of discharge marks were observed on the receptor drum for the color toner from Comparative Example 6 in which the quantity of aggregate of the conductive titanium oxide contained in the electrophotographic color toner is 1.1 weight %, while little change was observed for the color toner from Comparative Examples 4 and 5.

An image having a low density was obtained from Comparative Example 3. The reason for this is considered that the lack of addition of the conductive titanium oxide has increased electric resistance of toner to prevent obtaining sufficient amount of development of the electrostatic latent image to extremely increase the toner charge during the continuous printing, thereby further reducing the amount of development.

As described above, it has been found that in Examples 1 through 12 using the conductive needle-shaped titanium oxide obtained by a burning process, the quantity of the aggregated particles has been reduced to 1 weight % or less, and the resistance has been reduced to the same level as that for monochrome toner by (internally or externally) adding a small amount of conductive fine particles. Further, it has been found that addition of the conductive fine particles obtained by a burning process has allowed obtaining the toner in which reduction of chroma such as increase of opacity in the printed image is not observed, and the problems of image degradation by the leak of toner charge and of the device failure by the leak of high voltage due to adhesion to a charging device or a transfer device, caused by the aggregated particles in the conductive fine particles, do not occur. It has been found that the electrophotographic color toner of Examples 1 through 12 can develop images having vivid color with stability.

What is claimed is:

1. An electrophotographic color toner comprising:

a colorant;

a binder resin; and an additive, wherein the additive includes burned particles selected from titanium oxide particles and tin oxide particles obtained by a burning process;

wherein the burned particles are internally added to the electrophotographic color toner;

and wherein the surface of the titanium oxide particles is coated with tin oxide.

2. The electrophotographic color toner according to claim 1, wherein the amount of aggregated particles having a volume average diameter ($D_{50}$) of 10 $\mu$m or more in the burned particles is 1 weight % or less relative to the total electrophotographic color toner.

3. The electrophotographic color toner according to claim 1, wherein the amount of aggregated particles having a volume average diameter ($D_{50}$) of 10 $\mu$m or more in the burned particles is 0.2 weight % or less relative to the total electrophotographic color toner.

4. The electrophotographic color toner according to claim 1, wherein the tin oxide on the surface of the titanium oxide particles further includes an antimony oxide.

5. The electrophotographic color toner according to claim 1, wherein the surface of the burned particles is coated with an additional metal oxide.

6. The electrophotographic color toner according to claim 5, wherein the additional metal oxide is selected from $SnO_2$ and $Sb_2O_3$.

7. The electrophotographic color toner according to claim 1, wherein the burned particles are burned at 700 to 1000° C.

8. The electrophotographic color toner according to claim 1, wherein the amount of aggregated particles having a volume average diameter ($D_{50}$) of 10 $\mu$m or more in the burned particles is 20 weight % or less relative to the total burned particles.

9. The electrophotographic color toner according to claim 1, wherein the burned particles have an aspect ratio of 10 or more and an average major axis diameter of 5 $\mu$m or less.

10. The electrophotographic color toner according to claim 1, wherein the burned particles have a volume resistivity of from 1 to 100 Ωcm.

11. The electrophotographic color toner according to claim 1, wherein the electrophotographic color toner has a volume resistivity of from $20\times10^9$ to $60\times10^9$ Ωcm.

12. An electrophotographic color developer comprising:

an electrophotographic color toner including a colorant, a binder resin and an additive, wherein the additive includes burned particles selected from titanium oxide particles and tin oxide particles obtained by a burning process;

wherein the burned particles are internally added to the electrophotographic color toner;

and wherein the surface of the titanium oxide particles is coated with tin oxide.

13. A toner cartridge comprising:

an electrophotographic color toner at least including a colorant, a binder resin and an additive, wherein the additive includes burned particles selected from titanium oxide particles and tin oxide particles obtained by a burning process;

wherein the burned particles are internally added to the electrophotographic color toner;

and wherein the surface of the titanium oxide particles is coated with tin oxide.

14. An image forming device comprising:

an electrostatic latent image holding member;

an electrostatic latent image forming unit that forms an electrostatic latent image on the electrostatic latent image holding member;

a developing unit that contains an electrophotographic color developer including an electrophotographic color toner and develops the electrostatic latent image to form a toner image, the electrophotographic color toner at least including a colorant, a binder resin and an additive, wherein the additive includes burned particles selected from titanium oxide particles and tin oxide particles obtained by a burning process; and a transfer unit that transfers the toner image to a transfer material;

wherein the burned particles are internally added to the electrophotographic color toner;

and wherein the surface of the titanium oxide particles is coated with tin oxide.

15. The image forming device according to claim 14, further comprising a light-fixing unit that fixes the toner image transferred to the transfer material with light.

16. An image forming method, at least comprising the steps of:

forming an electrostatic latent image on an electrostatic latent image holding member;

developing by using an electrophotographic color developer including an electrophotographic color toner to develop the electrostatic latent image to form a toner image, the electrophotographic color toner at least including a colorant, a binder resin and an additive, wherein the additive includes burned particles selected from titanium oxide particles and tin oxide particles obtained by a burning process;

wherein the burned particles are internally added to the electrophotographic color toner; and wherein the surface of the titanium oxide particles is coated with tin oxide; and transferring the toner image to a transfer material.

17. The image forming method according to claim 16, further comprising the step of fixing the toner image with light.

* * * * *